US012391890B2

(12) United States Patent
Akah et al.

(10) Patent No.: US 12,391,890 B2
(45) **Date of Patent: *Aug. 19, 2025**

(54) INTEGRATED PROCESS FOR CONVERSION OF WHOLE CRUDE TO LIGHT OLEFINS

(71) Applicant: Saudi Arabian Oil Company, Dhahran (SA)

(72) Inventors: Aaron Chi Akah, Dhahran (SA); Qi Xu, Dhahran (SA); Musaed Salem Al-Ghrami, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 611 days.

This patent is subject to a terminal disclaimer.

(21) Appl. No.: 17/009,092

(22) Filed: Sep. 1, 2020

(65) Prior Publication Data

US 2022/0064548 A1 Mar. 3, 2022

(51) Int. Cl.

| | |
|---|---|
| ***C10G 55/06*** | (2006.01) |
| ***C10G 11/05*** | (2006.01) |
| ***C10G 11/20*** | (2006.01) |

(52) U.S. Cl.

CPC ..... *C10G 55/06* (2013.01); *C10G 11/05* (2013.01); *C10G 11/20* (2013.01);

(Continued)

(58) Field of Classification Search

CPC ..... C10G 69/06; C10G 69/14; C10G 47/00; C10G 11/20; C10G 11/18;

(Continued)

(56) References Cited

U.S. PATENT DOCUMENTS 2,525,276 A * 10/1950 Shapleigh ..... C10G 9/36 196/116
3,361,535 A * 1/1968 Pollitzer ..... C01B 3/38 423/651

(Continued)

FOREIGN PATENT DOCUMENTS

CN 101747129 A * 6/2010
EP 0909804 * 4/1999

(Continued)

OTHER PUBLICATIONS

Akah et al., "An Overview of Light Olefins Production via Steam Enhanced Catalytic Cracking", Catalysis Surveys from Asia, vol. 23, pp. 265-276, 2019.

(Continued)

*Primary Examiner* — Michelle Stein
(74) *Attorney, Agent, or Firm* — DINSMORE & SHOHL LLP

(57) ABSTRACT

Light olefins may be produced from a hydrocarbon feed by a method that includes separating the hydrocarbon feed into at least a light gas fraction stream comprising $C_1$-$C_4$ alkanes, a light fraction stream comprising $C_{5+}$ alkanes, and a heavy fraction stream. The temperature cut between the light fraction stream and the heavy fraction stream may be at 280° C. to 320° C. The method may further include steam cracking at least a portion of the light gas fraction stream to produce a steam cracked effluent stream and catalytically cracking at least a portion of the light fraction stream and the heavy fraction stream in a steam enhanced catalytic cracker (SECC) to produce a catalytically cracked effluent stream. The steam cracked effluent stream and the catalytically cracked effluent stream may be sent to a product separator to produce the light olefins.

20 Claims, 3 Drawing Sheets

(52) U.S. Cl.
CPC . *C10G 2300/301* (2013.01); *C10G 2300/308* (2013.01); *C10G 2300/4006* (2013.01); *C10G 2300/4081* (2013.01); *C10G 2300/807* (2013.01); *C10G 2400/20* (2013.01)

(58) Field of Classification Search
CPC .... C10G 2300/4081; C10G 2300/4006; C10G 2300/807; C10G 2300/4012; C10G 2300/308; C10G 2300/301; C10G 2400/30; C10G 2400/20; C10G 2400/02
See application file for complete search history.

(56) References Cited

U.S. PATENT DOCUMENTS

| | | | | |
|---|---|---|---|---|
| 3,702,292 | A * | 11/1972 | Burich | C10G 9/005 208/80 |
| 3,872,179 | A * | 3/1975 | Andersen | B01J 23/78 585/653 |
| 4,111,793 | A * | 9/1978 | Kolombos | B01J 23/34 208/121 |
| 4,361,478 | A * | 11/1982 | Gengler | C10G 9/206 208/132 |
| 6,660,158 | B1 * | 12/2003 | Ellingsen | B01J 8/1827 208/113 |
| 7,513,988 | B2 | 4/2009 | Oballa et al. | |
| 9,228,139 | B2 | 1/2016 | Shafi et al. | |
| 9,228,140 | B2 | 1/2016 | Abba et al. | |
| 9,228,141 | B2 | 1/2016 | Sayed et al. | |
| 10,301,556 | B2 | 5/2019 | Al-Ghamdi et al. | |
| 11,242,493 | B1 | 2/2022 | Xu et al. | |
| 2001/0021688 | A1 * | 9/2001 | Pollesel | C01F 7/164 585/653 |
| 2004/0054247 | A1 * | 3/2004 | Powers | C10G 11/20 208/130 |
| 2005/0010075 | A1 * | 1/2005 | Powers | C07C 4/04 585/648 |
| 2005/0148806 | A1 * | 7/2005 | Cruijsberg | C10G 9/36 585/652 |
| 2006/0178546 | A1 * | 8/2006 | Mo | C10G 11/182 585/648 |
| 2008/0078696 | A1 * | 4/2008 | Kirkham | C10G 9/20 208/125 |
| 2013/0015100 | A1 * | 1/2013 | Pereira Almao | C10L 1/08 502/308 |
| 2013/0137909 | A1 * | 5/2013 | Dean | C10G 11/18 585/324 |
| 2013/0140214 | A1 * | 6/2013 | Choi | C10G 31/08 208/102 |
| 2013/0210611 | A1 | 8/2013 | Kim et al. | |
| 2013/0248419 | A1 | 9/2013 | Abba et al. | |
| 2013/0289144 | A1 * | 10/2013 | Steyn | C10G 2/332 518/712 |
| 2016/0369184 | A1 | 12/2016 | Ward et al. | |
| 2016/0369189 | A1 | 12/2016 | Ward et al. | |
| 2017/0327750 | A1 * | 11/2017 | Al Yami | C10G 9/00 |
| 2018/0057758 | A1 * | 3/2018 | Al-Ghamdi | C10G 11/18 |
| 2018/0142167 | A1 * | 5/2018 | Al-Ghamdi | C10G 69/06 |
| 2018/0305623 | A1 * | 10/2018 | Al-Ghrami | C10G 11/182 |
| 2018/0305626 | A1 | 10/2018 | Bauer | |
| 2019/0062655 | A1 * | 2/2019 | Housmans | C10G 69/02 |
| 2019/0225894 | A1 * | 7/2019 | Bourane | C10G 55/08 |
| 2020/0392055 | A1 * | 12/2020 | Nesterenko | C10G 11/20 |
| 2021/0253961 | A1 * | 8/2021 | Osby | C07C 7/10 |

FOREIGN PATENT DOCUMENTS

| | | | | |
|---|---|---|---|---|
| WO | WO-0245850 | A2 * | 6/2002 | B01J 23/92 |
| WO | 2015128042 | A1 | 9/2015 | |
| WO | 2019239353 | A1 | 12/2019 | |
| WO | 2020021352 | A1 | 1/2020 | |

OTHER PUBLICATIONS

International Search Report and Written Opinion dated Jun. 25, 2021 pertaining to International application No. PCT/US2021/023840 filed Mar. 24, 2021, 12 pages.
International Search Report and Written Opinion dated Dec. 10, 2021 pertaining to International application No. PCT/US2021/047940 filed Aug. 27, 2021, 14 pages.
International Search Report and Written Opinion dated Dec. 3, 2021 pertaining to International application No. PCT/US2021/047977 filed Aug. 27, 2021, 12 pages.
U.S. Office Action dated Jan. 25, 2022 pertaining to U.S. Appl. No. 17/009,076, filed Sep. 1, 2020, 19 pages.
U.S. Office Action dated Jan. 26, 2022 pertaining to U.S. Appl. No. 17/009,095, filed Sep. 1, 2020, 20 pages.
U.S. Office Action dated Sep. 15, 2021 pertaining to U.S. Appl. No. 17/009,076, filed Sep. 1, 2020, 20 pages.
U.S. Office Action dated Sep. 15, 2021 pertaining to U.S. Appl. No. 17/009,095, filed Sep. 1, 2020, 21 pages.

* cited by examiner

INTEGRATED PROCESS FOR CONVERSION OF WHOLE CRUDE TO LIGHT OLEFINS

TECHNICAL FIELD

Embodiments of the present disclosure generally relate to chemical processing and, more specifically, to processes and systems for processing crude oil to light olefins.

BACKGROUND

Light olefins such as ethylene, propylene, butylene, and butadiene are basic intermediates for a large proportion of the petrochemical industry. They are usually obtained through the thermal cracking (or steam pyrolysis) of petroleum gases and distillates such as naphtha, kerosene or even gas oil. These compounds are also produced through refinery fluidized catalytic cracking (FCC) process where classical heavy feedstocks such as gas oils or residues are converted. Typical FCC feedstocks range from hydrocracked bottoms to heavy feed fractions such as vacuum gas oil and atmospheric residue; however, these feedstocks are limited. With ever growing demand for light olefins, FCC unit owners look increasingly to the petrochemicals market.

The worldwide increasing demand for light olefins remains a major challenge for many integrated refineries. In particular, the production of some valuable light olefins such as ethylene, propylene, and butylene has attracted increased attention as pure olefin streams are considered the building blocks for polymer synthesis. The production of light olefins depends on several process variables like the feed type, operating conditions, and the type of catalyst.

SUMMARY

Despite the options available for producing a greater yield of light olefins, intense research activity in this field is still being conducted. It is desirable to produce light olefins directly from a crude oil source. However, such methods are problematic since crude oils contain very heavy components, which may interfere with, for example, steam or catalytic cracking procedures. Therefore, there is a continual need for improved processes for providing light olefins from whole crude. The present embodiments meet this need through an integrated process that utilizes crude oil separation, steam cracking, and steam enhanced catalytic cracking.

According to one embodiment, a method for producing light olefins from a hydrocarbon feed is provided. The method comprises introducing the hydrocarbon feed having an American Petroleum Institute (API) gravity value above 35° into a feed separator to separate the hydrocarbon feed into at least a light gas fraction stream comprising $C_1$-$C_4$ alkanes, a light fraction stream comprising $C_{5+}$ alkanes, and a heavy fraction stream, wherein the temperature cut between the light fraction stream and the heavy fraction stream is from 280° C. to 320° C. The method further comprises: passing the light gas fraction stream to a steam cracker to steam crack at least a portion of the light gas fraction stream and produce a steam cracked effluent stream; introducing the light fraction stream and the heavy fraction stream to a steam enhanced catalytic cracker (SECC) in the presence of steam to catalytically crack at least a portion of the light fraction stream and the heavy fraction stream and produce a catalytically cracked effluent stream, wherein the weight ratio of steam to the light fraction stream and the heavy fraction stream is from 1:5 to 1:1; and passing the steam cracked effluent stream and the catalytically cracked effluent stream to a product separator to produce the light olefins.

According to another embodiment, a method for producing light olefins from a hydrocarbon feed comprises: separating the hydrocarbon feed having an American Petroleum Institute (API) gravity value above 35 into at least a light gas fraction stream comprising $C_1$-$C_4$ alkanes, a light fraction stream comprising $C_{5+}$ alkanes, and a heavy fraction stream, wherein the temperature cut between the light fraction stream and the heavy fraction stream is at 280° C. to 320° C.; and non-catalytically steam cracking the light gas fraction stream to produce a steam cracked effluent stream; catalytically cracking the light fraction stream and the heavy fraction stream in the presence of steam to produce a catalytically cracked effluent stream, wherein the weight ratio of steam to the light fraction stream and the heavy fraction stream is from 1:5 to 1:1; and separating the steam cracked effluent stream and the catalytically cracked effluent stream to produce the light olefins.

Additional features and advantages of the described embodiments will be set forth in the detailed description which follows, and in part will be readily apparent to those skilled in the art from that description or recognized by practicing the described embodiments, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
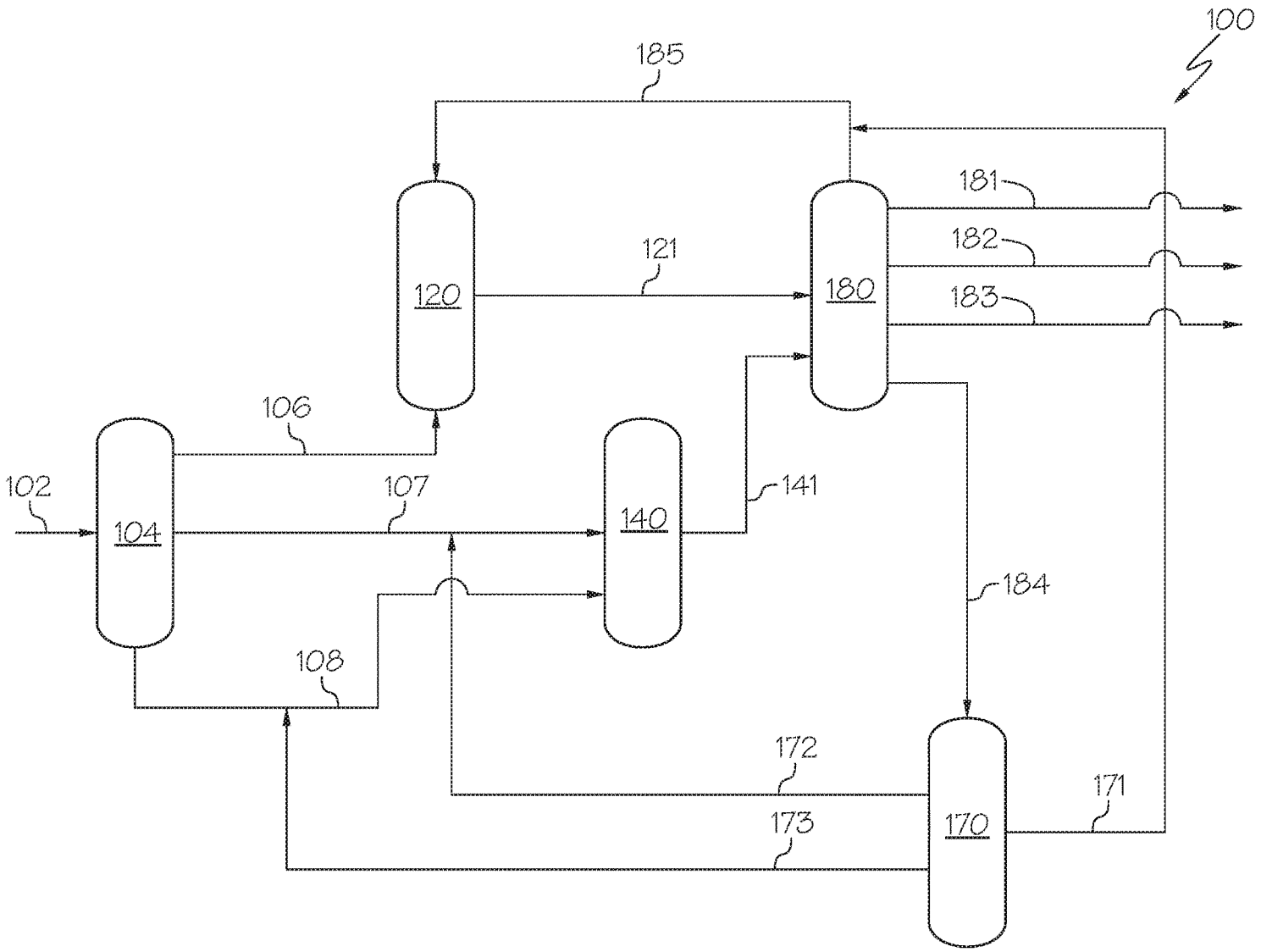
FIG. 1 is a generalized schematic diagram of a hydrocarbon conversion system, according to one or more embodiments described in this disclosure.

For the purpose of describing the simplified schematic illustrations and descriptions of the relevant figures, the numerous valves, temperature sensors, electronic controllers and the like that may be employed and well known to those of ordinary skill in the art of certain chemical processing operations are not included. Further, accompanying components that are often included in typical chemical processing operations, such as air supplies, catalyst hoppers, and flue gas handling systems, are not depicted. It should be understood that these components are within the spirit and scope of the present embodiments disclosed. However, operational components, such as those described in the present disclosure, may be added to the embodiments described in this disclosure.

It should further be noted that arrows in the drawings refer to process streams. However, the arrows may equivalently refer to transfer lines which may serve to transfer process streams between two or more system components. Additionally, arrows that connect to system components define inlets or outlets in each given system component. The arrow direction corresponds generally with the major direction of movement of the materials of the stream contained within the physical transfer line signified by the arrow. Further-more, arrows which do not connect two or more system components signify a product stream which exits the depicted system or a system inlet stream which enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawings may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component.

It should be understood that according to the embodiments presented in the relevant figures, an arrow between two system components may signify that the stream is not processed between the two system components. In other embodiments, the stream signified by the arrow may have substantially the same composition throughout its transport between the two system components. Additionally, it should be understood that in one or more embodiments, an arrow may represent that at least 75 wt. %, at least 90 wt. %, at least 95 wt. %, at least 99 wt. %, at least 99.9 wt. %, or even 100 wt. % of the stream is transported between the system components. As such, in some embodiments, less than all of the stream signified by an arrow may be transported between the system components, such as if a slip stream is present.

It should be understood that two or more process streams are "mixed" or "combined" when two or more lines intersect in the schematic flow diagrams of the relevant figures. Mixing or combining may also include mixing by directly introducing both streams into a like reactor, separation device, or other system component. For example, it should be understood that when two streams are depicted as being combined directly prior to entering a separation unit or reactor, that in some embodiments the streams could equivalently be introduced into the separation unit or reactor and be mixed in the reactor. Alternatively, when two streams are depicted to independently enter a system component, they may in some embodiments be mixed together before entering that system component.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

One or more embodiments of the present disclosure are directed to systems and processes for producing light olefins from a hydrocarbon feed. In general, a hydrocarbon feed may be separated into at least three streams of different compositions based on boiling point, referred to herein as the light gas fraction stream, the light fraction stream, and the heavy fraction stream. The light gas fraction stream may be passed to a steam cracker to steam crack at least a portion of the light gas fraction and produce a steam cracked effluent stream. The light fraction stream and the heavy fraction stream may be passed to an SECC to catalytically crack at least a portion of the light fraction stream and the heavy fraction stream and produce a catalytically cracked effluent stream. The steam cracked effluent stream and the catalytically cracked effluent stream may be sent to a product separation unit to produce light olefins. A heavy component stream outputted from the product separator may be hydrotreated. At least a portion of the hydrotreated heavy component stream may then be recycled to the SECC.

As used in this disclosure, a "reactor" refers to a vessel in which one or more chemical reactions may occur between one or more reactants optionally in the presence of one or more catalysts. For example, a reactor may include a tank or tubular reactor configured to operate as a batch reactor, a continuous stirred-tank reactor (CSTR), or a plug flow reactor. Example reactors include packed bed reactors such as fixed bed reactors, and fluidized bed reactors. One or more "reaction zones" may be disposed in a reactor. As used in this disclosure, a "reaction zone" refers to an area where a particular reaction takes place in a reactor. For example, a packed bed reactor with multiple catalyst beds may have multiple reaction zones, where each reaction zone is defined by the area of each catalyst bed.

As used in this disclosure, a "separation unit" refers to any separation device that at least partially separates one or more chemicals that are mixed in a process stream from one another. For example, a separation unit may selectively separate differing chemical species, phases, or sized material from one another, forming one or more chemical fractions. Examples of separation units include, without limitation, distillation columns, flash drums, knock-out drums, knock-out pots, centrifuges, cyclones, filtration devices, traps, scrubbers, expansion devices, membranes, solvent extraction devices, and the like. It should be understood that separation processes described in this disclosure may not completely separate all of one chemical constituent from all of another chemical constituent. It should be understood that the separation processes described in this disclosure "at least partially" separate different chemical components from one another, and that even if not explicitly stated, it should be understood that separation may include only partial separation. As used in this disclosure, one or more chemical constituents may be "separated" from a process stream to form a new process stream. Generally, a process stream may enter a separation unit and be divided, or separated, into two or more process streams of desired composition. Further, in some separation processes, a light gas fraction stream comprising $C_1$-$C_4$ alkanes, a light fraction stream and a heavy fraction stream may exit the separation unit, where, on average, the contents of the light fraction stream have a greater boiling point than the contents of the light gas fraction stream and a lesser boiling point than the contents of the heavy fraction stream.

It should be understood that an "effluent" generally refers to a stream that exits a system component such as a separation unit, a reactor, or reaction zone, following a particular reaction or separation, and generally has a different composition (at least proportionally) than the stream that entered the separation unit, reactor, or reaction zone.

As used in this disclosure, a "catalyst" refers to any substance that increases the rate of a specific chemical reaction. Catalysts described in this disclosure may be utilized to promote various reactions, such as, but not limited to, cracking (including aromatic cracking), demetalization, desulfurization, and denitrogenation. As used in this disclosure, "cracking" generally refers to a chemical reaction where carbon-carbon bonds are broken. For example, a molecule having carbon to carbon bonds is broken into more than one molecule by the breaking of one or more of the carbon to carbon bonds, or is converted from a compound which includes a cyclic moiety, such as a cycloalkane, cycloalkane, naphthalene, an aromatic or the like, to a compound which does not include a cyclic moiety or contains fewer cyclic moieties than prior to cracking.

As used in this disclosure, the term "first catalyst" refers to catalyst that is introduced to the first cracking reaction zone, such as the catalyst passed from the first catalyst mixing zone to the first cracking reaction zone. The first catalyst may include at least one of regenerated catalyst, spent first catalyst, spent second catalyst, fresh catalyst, or combinations of these. As used in this disclosure, the term "second catalyst" refers to catalyst that is introduced to the second cracking reaction zone, such as the catalyst passed from the second catalyst mixing zone to the second cracking reaction zone for example. The second catalyst may include at least one of regenerated catalyst, spent first catalyst, spent second catalyst, fresh catalyst, or combinations of these.

As used in this disclosure, the term "spent catalyst" refers to catalyst that has been introduced to and passed through a cracking reaction zone to crack a hydrocarbon material, such as the heavy fraction or the light fraction for example, but has not been regenerated in the regenerator following introduction to the cracking reaction zone. The "spent catalyst" may have coke deposited on the catalyst and may include partially coked catalyst as well as fully coked catalysts. The amount of coke deposited on the "spent catalyst" may be greater than the amount of coke remaining on the regenerated catalyst following regeneration.

As used in this disclosure, the term "regenerated catalyst" refers to catalyst that has been introduced to a cracking reaction zone and then regenerated in a regenerator to heat the catalyst to a greater temperature, oxidize and remove at least a portion of the coke from the catalyst to restore at least a portion of the catalytic activity of the catalyst, or both. The "regenerated catalyst" may have less coke, a greater temperature, or both compared to spent catalyst and may have greater catalytic activity compared to spent catalyst. The "regenerated catalyst" may have more coke and lesser catalytic activity compared to fresh catalyst that has not passed through a cracking reaction zone and regenerator.

It should further be understood that streams may be named for the components of the stream, and the component for which the stream is named may be the major component of the stream (such as comprising from 50 weight percent (wt. %), from 70 wt. %, from 90 wt. %, from 95 wt. %, from 99 wt. %, from 99.5 wt. %, or even from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "propylene stream" passing from a first system component to a second system component should be understood to equivalently disclose "propylene" passing from a first system component to a second system component, and the like.

Referring to FIG. 1, the hydrocarbon feed stream 102 may generally comprise a crude oil. As used in this disclosure, the term "crude oil" is to be understood to mean a mixture of petroleum liquids, gases, or combinations of liquids and gases, including some embodiments impurities such as sulfur-containing compounds, nitrogen-containing compounds and metal compounds that has not undergone significant separation or reaction processes. Crude oils are distinguished from fractions of crude oil. In certain embodiments the crude oil feedstock may be a minimally treated light crude oil to provide a crude oil feedstock having total metals (Ni+V) content of less than 5 parts per million by weight (ppmw) and Conradson carbon residue of less than 5 wt %. Such minimally treated materials may be considered crude oils as described herein.

While the present description and examples may specify crude oil as the hydrocarbon material of the hydrocarbon feed stream 102, it should be understood that the hydrocarbon feed conversion system 100 described with respect to the embodiments of FIG. 1, may be applicable for the conversion of a wide variety of hydrocarbon materials, which may be present in the hydrocarbon feed stream 102, including, but not limited to, crude oil, vacuum residue, tar sands, bitumen, atmospheric residue, vacuum gas oils, demetalized oils, naphtha streams, other hydrocarbon streams, or combinations of these materials. The hydrocarbon feed stream 102 may include one or more non-hydrocarbon constituents, such as one or more heavy metals, sulphur compounds, nitrogen compounds, inorganic components, or other non-hydrocarbon compounds. If the hydrocarbon feed stream 102 is crude oil, it may have an American Petroleum Institute (API) gravity of greater than 22 degrees or greater than 35 degrees. For example, the hydrocarbon feed stream 102 utilized may be an Arab heavy crude oil (API gravity of approximately 28°), Arab medium (API gravity of approximately 30°), Arab light (API gravity of approximately 33°), or Arab extra light (API gravity of approximately 39°). It should be understood that, as used in this disclosure, a "hydrocarbon feed" may refer to a raw hydrocarbon material which has not been previously treated, separated, or otherwise refined (such as crude oil) or may refer to a hydrocarbon material which has undergone some degree of processing, such as treatment, separation, reaction, purifying, or other operation, prior to being introduced to the hydrocarbon feed conversion system 100 in the hydrocarbon feed stream 102.

In general, the contents of the hydrocarbon feed stream 102 may include a relatively wide variety of chemical species based on boiling point. For example, the hydrocarbon feed stream 102 may have a composition such that the difference between the 5 wt. % boiling point and the 95 wt. % boiling point of the hydrocarbon feed stream 102 is at least 100° C., at least 200° C., at least 300° C., at least 400° C., at least 500° C., or even at least 600° C.

Referring to FIG. 1, the hydrocarbon feed stream 102 may be introduced to the feed separator 104 which may separate the contents of the hydrocarbon feed stream 102 into at least the light gas fraction stream 106, the light fraction stream 107, and the heavy fraction stream 108. In one or more embodiments, at least 90 wt. %, at least 95 wt. %, at least 99 wt. %, or even at least 99.9 wt. % of the hydrocarbon feed stream 102 may be present in the combination of the light gas fraction stream 106, the light fraction stream 107, and the heavy fraction stream 108. In one or more embodiments, the feed separator 104 may be a series of vapor-liquid separators such as a flash drum (sometimes referred to as a breakpot, knock-out drum, knock-out pot, compressor suction drum, or compressor inlet drum). The vapor-liquid separators may be operated at a temperature and pressure suitable to separate the hydrocarbon feed stream 102 into the light gas fraction stream 106, the light fraction stream 107, and the heavy fraction stream 108. In an embodiment, the feed separator may operate at a temperature of 200° C. to 400° C. to separate the light fraction from the heavy fraction. It should be understood that a wide variety of fractionating separators may be utilized, such as distillation columns and the like.

In one or more embodiments, the light gas fraction stream 106 comprises $C_1$-$C_4$ alkanes and may have a final boiling point of less than 35° C. such as less than 30° C. In some embodiments, the lightest components of the light gas fraction stream may comprise components that are gases at the environmental temperatures (such as the natural temperature of the plant site).

In one or more embodiments, the light fraction stream 107 may have a final boiling point of less than 300° C., or less than 290° C., or less than 280° C. In some embodiments, the light fraction stream 107 may generally include naphtha. In some embodiments, the lightest components of the light fraction stream 107 may be those that are liquid at the environmental temperatures (such as the natural temperature at the plant site). As described herein, the cut points, final boiling points, and initial boiling points are described in atmospheric pressure.

In one or more embodiments, the heavy fraction stream 108 may have a final boiling point of greater than 300° C., or greater than 310° C., or greater than 320° C.

In some embodiments, the final boiling point of the light fraction stream 107 may be equal to the initial boiling point of the heavy fraction stream 108. In such embodiments, a "cut point" (at atmospheric pressure) may be said to exist between the respective fractions. In these embodiments, the cut point between the light fraction stream 107 and the heavy fraction stream 108 may be from 280° C. to 320° C., or from 290° C. to 310° C., or from 295° C. to 305° C. As described herein, the initial boiling point generally refers to the temperature at which components begin to boil in a hydrocarbon composition, and final boiling point generally refers to the temperature at which all components boil in a hydrocarbon composition.

One or more supplemental feed streams (not shown) may be added to the hydrocarbon feed stream 102 prior to introducing the hydrocarbon feed stream 102 to the feed separator 104. As previously described, in one or more embodiments, the hydrocarbon feed stream 102 may be crude oil. In one or more embodiments, the hydrocarbon feed stream 102 may be crude oil, and one or more supplemental feed streams comprising one or more of a vacuum residue, tar sands, bitumen, atmospheric residue, vacuum gas oils, demetalized oils, naphtha streams, other hydrocarbon streams, or combinations of these materials, may be added to the crude oil upstream of the feed separator 104.

Although some embodiments of the present disclosure focus on converting a hydrocarbon feed stream 102 that is a crude oil, the hydrocarbon feed stream 102 may alternatively comprise a plurality of refinery hydrocarbon streams outputted from one or more crude oil refinery operations. The plurality of refinery hydrocarbon streams may include a vacuum residue, an atmospheric residue, or a vacuum gas oil, for example. In some embodiments, the plurality of refinery hydrocarbon streams may be combined into the hydrocarbon feed stream 102. In these embodiments, the hydrocarbon feed stream 102 may be introduced to the feed separator 104 and separated into the light gas fraction stream 106, the light fraction stream 107, and the heavy fraction stream 108.

According to one or more embodiments, the light gas fraction stream 106 may be passed to a steam cracker unit.

Figure 2:
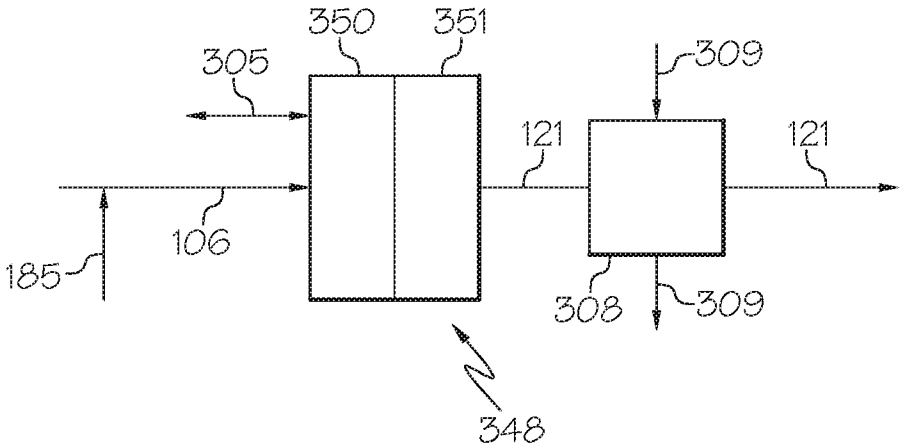
FIG. 2 depicts a generalized schematic diagram of a steam cracking unit, according to one or more embodiments described in this disclosure.

Now referring to FIG. 2, a steam cracking and separation system is depicted which is representative of the steam cracking unit 120 of FIG. 1. While FIG. 2 represents one embodiment of a steam cracking unit, other configurations of steam cracking units are contemplated. The steam cracker unit 348 may include a convection zone 350 and a pyrolysis zone 351. The light gas fraction stream 106 may pass into the convection zone 350 along with steam 305. In the convection zone 350, the mixture comprising the light gas and steam stream 303 may be pre-heated to a desired temperature. The contents of stream 303 present in the convection zone 350 may then be passed to the pyrolysis zone 351 where it is steam-cracked. The steam cracked effluent stream 121 may exit the steam cracker unit 348 and optionally be passed through a heat exchanger 308 where process fluid 309, such as water, cools the steam cracked effluent stream 121. The steam cracked effluent stream 121 may include a mixture of cracked hydrocarbon-based materials which may be separated into one or more petrochemical products included in one or more system product streams. For example, the steam cracked effluent stream 121 may include one or more of methane, hydrogen gas, ethylene, propylene, butadiene, mixed butenes, and/or $C_{5+}$, which may further be mixed with water from the steam cracking.

According to one or more embodiments, the pyrolysis zone 351 may operate at a temperature of from 750° C. to 1000° C. or from 800° C. to 950° C. The pyrolysis zone 351 may operate with a residence time of from 0.05 seconds to 2 seconds. The mass ratio of steam 305 to the light gas fraction stream 106 may be from about 0.3:1 to about 2:1.

As is depicted in FIG. 1, the light fraction stream 107 and the heavy fraction stream 108 may be passed from the feed separator 104 to the SECC unit 140. An SECC unit operates at temperatures of 550° C. or greater and a weight ratio of steam to hydrocarbon (i.e., light fraction and heavy fraction) of equal to or greater than 1:5. These are more severe conditions than atypical FCC unit, which operates at temperatures below 550° C. with a weight ratio of steam to hydrocarbon of between 1:100 and 1:10.

Figure 3:
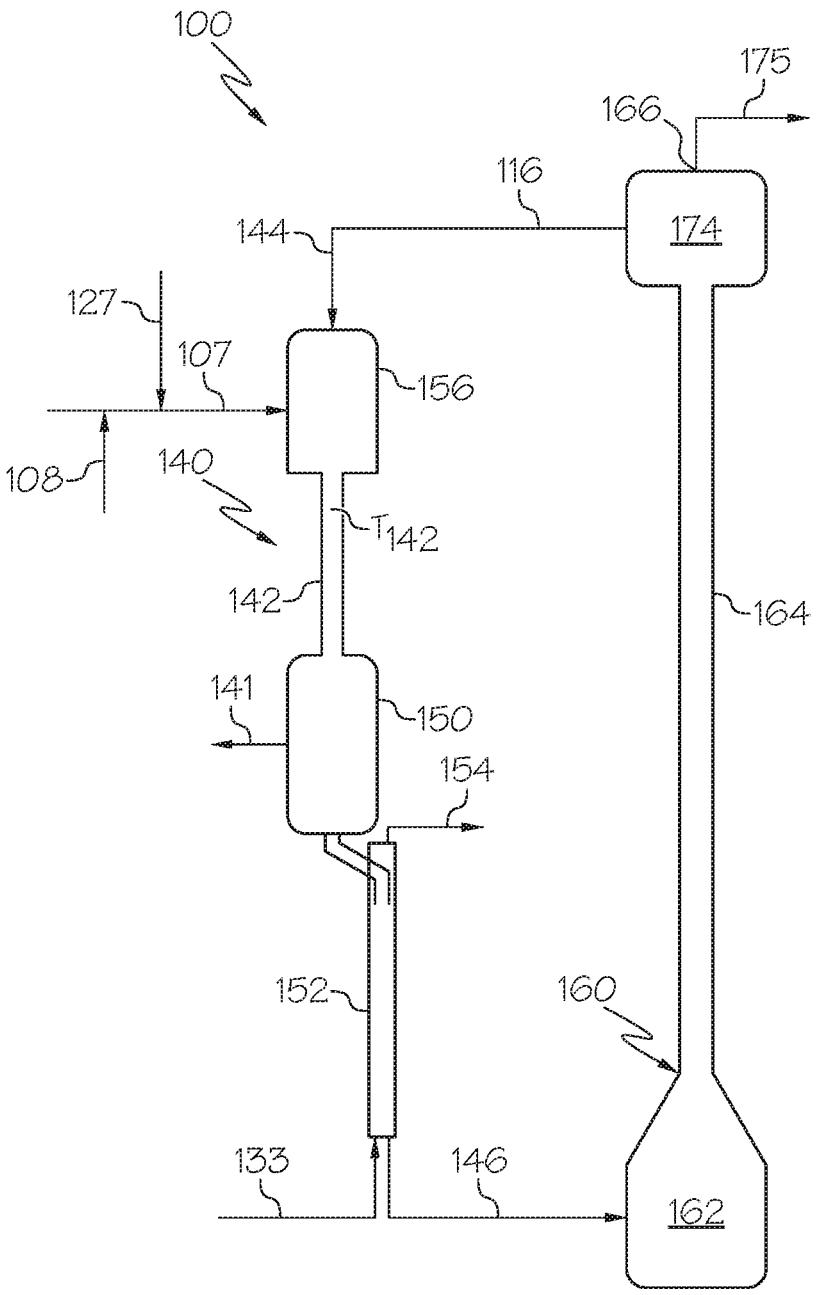
FIG. 3 depicts a generalized schematic diagram of a steam enhanced catalytic cracker (SECC) unit, according to one or more embodiments described in this disclosure.

Now referring to FIG. 3, an embodiment of an SECC unit 140 is depicted. It should be understood that other configurations of SECC units are contemplated for use in the hydrocarbon feed conversion system 100. The SECC unit 140 may include a catalyst/feed mixing zone 156, a cracking reaction zone 142, a separation zone 150, and a stripping zone 152. The light fraction stream 107 may be introduced to the catalyst/feed mixing zone 156, where the light fraction stream 107 may be mixed with the catalyst 144. During steady state operation of the SECC unit 140, the catalyst 144 may include at least the regenerated catalyst 116 that is passed to the catalyst/feed mixing zone 156 from a catalyst hopper 174. In embodiments, the catalyst 144 may be a mixture of spent catalyst 146 and regenerated catalyst 116. The catalyst hopper 174 may receive the regenerated catalyst 116 from the regenerator 160 following regeneration of the spent catalyst 146. At initial start-up of the SECC unit 140, the catalyst 144 may include fresh catalyst (not shown), which is catalyst that has not been circulated through the SECC unit 140 and the regenerator 160. In embodiments, fresh catalyst may also be introduced to catalyst hopper 174 during operation of the hydrocarbon feed conversion system 100 so that at least a portion of the catalyst 144 introduced to the catalyst/feed mixing zone 156 includes the fresh catalyst. Fresh catalyst may be introduced to the catalyst hopper 174 periodically during operation to replenish lost catalyst or compensate for spent catalyst that becomes permanently deactivated, such as through heavy metal accumulation in the catalyst.

The mixture comprising the light fraction stream 107 and the catalyst 144 may be passed from the catalyst/feed mixing zone 156 to the cracking reaction zone 142. The mixture of the light fraction stream 107 and catalyst 144 may be introduced to a top portion of the cracking reaction zone 142. The cracking reaction zone 142 may be a downflow reactor or "downer" reactor in which the reactants flow from the catalyst/feed mixing zone 156 downward through the cracking reaction zone 142 to the separation zone 150. Steam may be introduced to the top portion of the cracking reaction zone 142 to provide additional heating to the mixture of the light fraction stream 107 and the catalyst 144. The light fraction stream 107 may be reacted by contact with the catalyst 144 in the cracking reaction zone 142 to cause at least a portion of the light fraction stream 107 to undergo at least one cracking reaction to form at least one cracking reaction product, which may include at least one of the petrochemical products previously described. The catalyst 144 may have a temperature equal to or greater than the cracking temperature $T_{142}$ of the cracking reaction zone 142 and may transfer heat to the light fraction stream 107 to promote the endothermic cracking reaction.

It should be understood that the cracking reaction zone 142 of the SECC unit 140 depicted in FIG. 3 is a simplified schematic of one particular embodiment of the cracking reaction zone 142, and other configurations of the cracking reaction zone 142 may be suitable for incorporation into the hydrocarbon feed conversion system 100. For example, in some embodiments, the cracking reaction zone 142 may be an up-flow cracking reaction zone. Other cracking reaction zone configurations are contemplated. The SECC unit may be a hydrocarbon feed conversion unit in which in the cracking reaction zone 142, the fluidized catalyst 144 contacts the light fraction stream 107. The cracking temperature $T_{142}$ of the cracking reaction zone 142 may be from 550° C. to 800° C., from 550° C. to 750° C., from 600° C. to 800° C., or from 600° C. to 750° C. In some embodiments, the cracking temperature $T_{142}$ of the cracking reaction zone 142 may be from 550° C. to 800° C. In other embodiments, the cracking temperature $T_{142}$ of the cracking reaction zone 142 may be from 600° C. to 750° C. In some embodiments, the cracking temperature $T_{142}$ may be different than the first cracking temperature $T_{122}$.

A weight ratio of the catalyst 144 to the light fraction stream 107 in the cracking reaction zone 142 (catalyst to hydrocarbon ratio) may be from 5:1 to 40:1, from 5:1 to 35:1, from 5:1 to 30:1, from 5:1 to 25:1, from 5:1 to 15:1, from 5:1 to 10:1, from 10:1 to 40:1, from 10:1 to 35:1, from 10:1 to 30:1, from 10:1 to 25:1, from 10:1 to 15:1, from 15:1 to 40:1, from 15:1 to 35:1, from 15:1 to 30:1, from 15:1 to 25:1, from 25:1 to 40:1, from 25:1 to 35:1, from 25:1 to 30:1, or from 30:1 to 40:1. The residence time of the mixture of catalyst 144 and the light fraction stream 107 in the cracking reaction zone 142 may be from 0.05 seconds (sec) to 20 sec or from 0.1 sec to 10 sec.

Following the cracking reaction in the cracking reaction zone 142, the contents of effluent from the cracking reaction zone 142 may include catalyst 144 and the catalytically cracked effluent stream 141, which may be passed to the separation zone 150. In the separation zone 150, the catalyst 144 may be separated from at least a portion of the catalytically cracked effluent stream 141. In embodiments, the separation zone 150 may include one or more gas-solid separators, such as one or more cyclones. The catalyst 144 exiting from the separation zone 150 may retain at least a residual portion of the catalytically cracked effluent stream 141.

After the separation zone 150, the catalyst 144 may be passed to the stripping zone 152, where at least some of the residual portion of the catalytically cracked effluent stream 141 may be stripped from the catalyst 144 and recovered as a stripped product stream 154. The stripped product stream 154 may be passed to one or more than one downstream unit operations or combined with one or more than one other streams for further processing. Steam 133 may be introduced to the stripping zone 152 to facilitate stripping the catalytically cracked effluent stream 141 from the catalyst 144. The stripped product stream 154 may include at least a portion of the steam 133 introduced to the stripping zone 152 and may be passed out of the stripping zone 152. The stripped product stream 154 may pass through cyclone separators (not shown) and out of the stripper vessel (not shown). The stripped product stream 154 may be directed to one or more product recovery systems in accordance with known methods in the art, such as recycled by combining with steam 127. The stripped product stream 154 may also be combined with one or more other streams, such as the catalytically cracked effluent stream 141. Combination with other streams is contemplated. For example, the first stripped product stream 134, which may comprise a majority steam, may be combined with steam 127. In another embodiment, the first stripped product stream 134 may be separated into steam and hydrocarbons, and the steam portion may be combined with steam 127. The spent catalyst 146, which is the catalyst 144 after stripping out the stripped product stream 154, may be passed from the stripping zone 152 to the regeneration zone 162 of the regenerator 160.

The catalyst 144 used in the hydrocarbon feed conversion system 100 may include one or more fluid catalytic cracking catalysts that are suitable for use in the cracking reaction zone 142. The catalyst may be a heat carrier and may provide heat transfer to the light fraction stream 107 in the cracking reaction zone 142. The catalyst may also have a plurality of catalytically active sites, such as acidic sites for example, that promote the cracking reaction. For example, in embodiments, the catalyst may be a high-activity FCC catalyst having high catalytic activity. Examples of fluid catalytic cracking catalysts suitable for use in the hydrocarbon feed conversion system 100 may include, without limitation, zeolites, silica-alumina catalysts, carbon monoxide burning promoter additives, bottoms cracking additives, light olefin-producing additives, other catalyst additives, or combinations of these components. Zeolites that may be used as at least a portion of the catalyst for cracking may include, but are not limited to Y, rare earth Y (REY), ultra-stable Y (USY), rare earth ultra-stable Y (RE-USY) zeolites, or combinations of these. The catalyst may also include a shaped selective catalyst additive, such as zeolite socony mobil-5 (ZSM-5) zeolite crystals or other pentasil-type catalyst structures, which are often used in other FCC processes to produce light olefins and/or increase FCC gasoline octane. In one or more embodiments, the catalyst may include a mixture of a ZSM-5 zeolite crystals and the cracking catalyst zeolite and matrix structure of a typical FCC cracking catalyst. In one or more embodiments, the catalyst may be a mixture of Y and ZSM-5 zeolite catalysts embedded with clay, alumina, and binder.

In one or more embodiments, at least a portion of the catalyst may be modified to include one or more rare earth elements (15 elements of the Lanthanide series of the IUPAC Periodic Table plus scandium and yttrium), alkaline earth metals (Group 2 of the IUPAC Periodic Table), transition metals, phosphorus, fluorine, or any combination of these, which may enhance olefin yield in the first cracking reaction zone 122, cracking reaction zone 142, or both. Transition metals may include "an element whose atom has a partially filled d sub-shell, or which can give rise to cations with an incomplete d sub-shell" [IUPAC, Compendium of Chemical Terminology, 2nd ed. (the "Gold Book") (1997). Online corrected version: (2006-) "transition element" ]. One or more transition metals or metal oxides may also be impregnated onto the catalyst. Metals or metal oxides may include one or more metals from Groups 6-10 of the IUPAC Periodic Table. In some embodiments, the metals or metal oxides may include one or more of molybdenum, rhenium, tungsten, or any combination of these. In one or more embodiments, a portion of the catalyst may be impregnated with tungsten oxide.

The regenerator 160 may include the regeneration zone 162, a catalyst transfer line 164, the catalyst hopper 174, and a flue gas vent 166. The catalyst transfer line 164 may be fluidly coupled to the regeneration zone 162 and the catalyst hopper 174 for passing the regenerated catalyst 116 from the regeneration zone 162 to the catalyst hopper 174. In some embodiments, the regenerator 160 may have more than one catalyst hopper 174, such as a first catalyst hopper (not shown) for the SECC unit 140, for example. In some embodiments, the flue gas vent 166 may be positioned at the catalyst hopper 174.

In operation, the spent catalyst 146 may be passed from the stripping zone 152 to the regeneration zone 162. Combustion gases may be introduced to the regeneration zone 162. The combustion gases may include one or more of combustion air, oxygen, fuel gas, fuel oil, other components, or any combinations of these. In the regeneration zone 162, the coke deposited on the spent catalyst 146 may at least partially oxidize (combust) in the presence of the combustion gases to form at least carbon dioxide and water. In some embodiments, the coke deposits on the spent catalyst 146 may be fully oxidized in the regeneration zone 162. Other organic compounds, such as residual first cracking reaction product or cracking reaction product for example, may also oxidize in the presence of the combustion gases in the regeneration zone. Other gases, such as carbon monoxide for example, may be formed during coke oxidation in the regeneration zone 162. Oxidation of the coke deposits produces heat, which may be transferred to and retained by the regenerated catalyst 116.

The flue gases 175 may convey the regenerated catalyst 116 through the catalyst transfer line 164 from the regeneration zone 162 to the catalyst hopper 174. The regenerated catalyst 116 may accumulate in the catalyst hopper 174 prior to passing from the catalyst hopper 174 to the SECC unit 140. The catalyst hopper 174 may act as a gas-solid separator to separate the flue gas 175 from the regenerated catalyst 116. In embodiments, the flue gas 175 may pass out of the catalyst hopper 174 through a flue gas vent 166 disposed in the catalyst hopper 174.

The catalyst may be circulated through the SECC unit 140, the regenerator 160, and the catalyst hopper 174. The catalyst 144 may be introduced to the SECC unit 140 to catalytically crack the light fraction stream 107 in the SECC unit 140. During cracking, coke deposits may form on the catalyst 144 to produce the spent catalyst 146 passing out of the stripping zone 152. The spent catalyst 146 also may have a catalytic activity that is less than the catalytic activity of the regenerated catalyst 116, meaning that the spent catalyst 146 may be less effective at enabling the cracking reactions compared to the regenerated catalyst 116. The spent catalyst 146 may be separated from the catalytically cracked effluent stream 141 in the separation zone 150 and the stripping zone 152. The spent catalyst 146 may then be regenerated in the regeneration zone 162 to produce the regenerated catalyst 116. The regenerated catalyst 116 may be transferred to the catalyst hopper 174.

The regenerated catalyst 116 passing out of the regeneration zone 162 may have less than 1 wt. % coke deposits, based on the total weight of the regenerated catalyst 116. In some embodiments, the regenerated catalyst 116 passing out of the regeneration zone 162 may have less than 0.5 wt. %, less than 0.1 wt. %, or less than 0.05 wt. % coke deposits. In some embodiments, the regenerated catalyst 116 passing out of the regeneration zone 162 to the catalyst hopper 174 may have from 0.001 wt. % to 1 wt. %, from 0.001 wt. % to 0.5 wt. %, from 0.001 wt. % to 0.1 wt. %, from 0.001 wt. % to 0.05 wt. %, from 0.005 wt. % to 1 wt. %, from 0.005 wt. % to 0.5 wt. %, from 0.005 wt. % to 0.1 wt. %, from 0.005 wt. % to 0.05 wt. %, from 0.01 wt. % to 1 wt. %, from 0.01 wt. % to 0.5 wt. % to 0.01 wt. % to 0.1 wt. %, from 0.01 wt. % to 0.05 wt. % coke deposits, based on the total weight of the regenerated catalyst 116. In one or more embodiments, the regenerated catalyst 116 passing out of regeneration zone 162 may be substantially free of coke deposits. As used in this disclosure, the term "substantially free" of a component means less than 1 wt. % of that component in a particular portion of a catalyst, stream, or reaction zone. As an example, the regenerated catalyst 116 that is substantially free of coke deposits may have less than 1 wt. % of coke deposits. Removal of the coke deposits from the regenerated catalyst 116 in the regeneration zone 162 may remove the coke deposits from the catalytically active sites, such as acidic sites for example, of the catalyst that promote the cracking reaction. Removal of the coke deposits from the catalytically active sites on the catalyst may increase the catalytic activity of the regenerated catalyst 116 compared to the spent catalyst 146. Thus, the regenerated catalyst 116 may have a catalytic activity that is greater than the spent catalyst 146.

The regenerated catalyst 116 may absorb at least a portion of the heat generated from combustion of the coke deposits. The heat may increase the temperature of the regenerated catalyst 116 compared to the temperature of the spent catalyst 146. The regenerated catalyst 116 may accumulate in the catalyst hopper 174 until it is passed back to the SECC unit 140 as at least a portion of the catalyst 144. The regenerated catalyst 116 in the catalyst hopper 174 may have a temperature that is equal to or greater than the cracking temperature $T_{142}$ in the cracking reaction zone 142 of the SECC unit 140. The greater temperature of the regenerated catalyst 116 may provide heat for the endothermic cracking reaction in the cracking reaction zone 142.

Steam 127 may be mixed with the light fraction stream 107 prior to being passed to the SECC unit 140. Steam 127 may be combined with the light fraction stream 107 upstream of the cracking of the light fraction stream 107. Steam 127 may act as a diluent to reduce a partial pressure of the hydrocarbons. The steam to hydrocarbon weight ratio of the combined mixture of steam 127 and the light fraction stream 107 may be at least 1:10. In additional embodiments, the steam to hydrocarbon weight ratio may be from 1:10 to 2:1, from 1:10 to 1:1, from 1:5 to 2:1, from 1:5 to 1:1, or any combination of these ranges.

Steam 127 may serve the purpose of lowering hydrocarbon partial pressure, which may have the dual effects of increasing yields of light olefins (e.g., ethylene, propylene and butylene) as well as reducing coke formation. Light olefins like propylene and butylene are mainly generated from catalytic cracking reactions following the carbonium ion mechanism, and as these are intermediate products, they can undergo secondary reactions such as hydrogen transfer and aromatization (leading to coke formation). Steam 127 may increase the yield of light olefins by suppressing these secondary bi-molecular reactions, and reduce the concentration of reactants and products, which favor selectivity towards light olefins. The steam 127 may also suppress secondary reactions that are responsible for coke formation on catalyst surface, which is good for catalysts to maintain high average activation. These factors may show that a large steam to hydrocarbon weight ratio is beneficial to the production of light olefins. However, the steam to hydrocarbon weight ratio may not be enhanced infinitely in the practical industrial operating process, since increasing the amount of steam 127 will result in the increase of the whole energy consumption, the decrease of disposal capacity of unit equipment, and the inconvenience of succeeding condensation and separation of products. Therefore, the optimum steam to hydrocarbon weight ratio may be a function of other operating parameters.

In some embodiments, steam 127 may also be used to preheat the heavy fraction stream 108. Before the heavy fraction stream 108 enters the SECC unit 140, the temperature of the heavy fraction stream 108 may be increased by mixing with the steam 127. However, it should be understood that the temperature of the mixed steam and oil streams may be less than or equal to 250° C. Temperatures greater than 250° C. may cause fouling caused by cracking of the heavy fraction stream 108. Fouling may lead to blockage of the reactor inlet. The reaction temperature (such as greater than 500° C.) may be achieved by using hot catalyst from the regeneration and/or fuel burners. That is, the steam 127 may be insufficient to heat the reactant streams to reaction temperatures, and may be ineffective in increasing the temperature by providing additional heating to the mixture at temperatures present inside of the reactors (e.g., greater than 500° C.). In some embodiments, the steam described herein in steam 127 is not utilized to increase temperature within the reactor, but rather to dilute the oils and reduce oil partial pressure in the reactor. Instead, the mixing of steam and oil may be sufficient to vaporize the oils at a temperature of less than 250° C. to avoid fouling.

Referring again to FIG. 1, the catalytically cracked effluent stream 141 may comprise fuel gas, C2-C4 paraffins, light olefins, gasoline, light cycle oil with components having boiling points from 221° C. to 343° C., and/or heavy cycle oil with components having boiling points greater than 343° C.

In one or more embodiments, the products of the steam cracking unit 120 and the SECC unit 140 may be further separated to produce light olefins and other system products or recycled within the hydrocarbon feed conversion system 100. It should be understood that, while FIG. 1 depicts various separation apparatuses and recycle streams, products of the steam cracking unit 120 and the SECC unit 140 may exit the system 100 as light olefins and other system products in some embodiments. However, herein described are one or more embodiments depicted in FIG. 1 which utilize recycling and separation of the one or more product effluents of the steam cracking unit 120 and the SECC unit 140.

In one or more embodiments, and as depicted in FIG. 1, the products of the steam cracking unit 120 i.e., the steam cracked effluent stream 121 may be passed to the product separation unit 180. In additional embodiments, the products of the SECC unit 140 i.e., the catalytically cracked effluent stream 141 may be passed to the product separation unit 180. The product separation unit 180 may be a distillation column or collection of separation devices that separates the steam cracked effluent stream 121, the catalytically cracked effluent stream 141, or both into one or more system product streams. The system product streams outputted from the product separation unit 180 may include the fuel gas stream 181, the light olefin stream 182, and the benzene, toluene, and xylene (BTX) stream 183. As presently described, "light olefins" which may exit in a product stream include ethylene, propylene, butylene, and butadiene. Additional streams exiting the product separation unit 180 may include off gas products.

Several other streams formed by the product separation unit 180 may be recycled in the hydrocarbon feed conversion system 100. For example, $C_2$-$C_4$ alkanes and methane may be passed to the steam cracking unit 120 via the $C_2$-$C_4$ alkanes and methane stream 185. Additionally, cracked naphtha, light cycle oil with components having boiling points from 221° C. to 343° C., and/or heavy cycle oil with components having boiling points greater than 343° C. may be passed to the hydrotreatment unit 170 via the heavy component stream 184. In some embodiments, hydrotreating the heavy components in the heavy component stream 184 before introduction into the SECC 140 results in less catalyst deactivation and coke formation in the SECC than would otherwise occur. In additional embodiments, the $C_2$-$C_4$ alkanes and methane stream 185 may be passed from the product separation unit 180 to the steam cracking unit 120.

The heavy component stream 184 may be passed to the hydrotreatment unit 170 where it is contacted by a hydrotreating catalyst. According to one or more embodiments, the hydrotreatment unit 170 operates at a temperature from 250° C. to 450° C. Contact by the hydrotreating catalyst with the heavy component stream 184 may remove heteroatom impurities in the contents of the heavy component stream 184 and may, in particular, remove sulfur and nitrogen impurities in the heavy component stream 184. The products of the hydrotreatment unit 170 may comprise fuel gas, LPG, naphtha, distillate, gas oil, and/or slurry. A wide variety of hydrotreating catalysts are contemplated as useful, and the description of some suitable hydrotreating catalysts should not be construed as limiting on the presently disclosed embodiments.

The hydrotreating catalyst may comprise one or more metals from IUPAC Groups 5, 6, 8, 9, or 10 of the periodic table. For example, the hydrotreating catalyst may comprise one or more metals from IUPAC Groups 5 or 6, and one or more metals from IUPAC Groups 8, 9, or 10 of the periodic table. For example, the hydrotreating catalyst may comprise molybdenum or tungsten from IUPAC Group 6 and nickel or cobalt from IUPAC Groups 8, 9, or 10. The catalyst may further comprise a support material, and the metal may be disposed on the support material, such as a zeolite. In one embodiment, the hydrocracking catalyst may comprise tungsten and nickel metal catalyst on a zeolite support. In another embodiment, the hydrocracking catalyst may comprise molybdenum and nickel metal catalyst on a zeolite support.

The zeolite support material is not necessarily limited to a particular type of zeolite. However, it is contemplated that zeolites such as Y, Beta, AWLZ-15, LZ-45, Y-82, Y-84, LZ-210, LZ-25, Silicalite, or mordenite may be suitable for use in the presently described hydrotreating catalyst. For example, suitable zeolites which can be impregnated with one or more catalytic metals such as W, Ni, Mo, or combinations thereof, are described in at least U.S. Pat. No. 7,785,563; Zhang et al., Powder Technology 183 (2008) 73-78; Liu et al., Microporous and Mesoporous Materials 181 (2013) 116-122; and Garcia-Martinez et al., Catalysis Science & Technology, 2012 (DOI: 10.1039/c2cy00309k).

In one or more embodiments, the hydrotreating catalyst may comprise from 18 wt. % to 28 wt. % of a sulfide or oxide of tungsten (such as from 20 wt. % to 27 wt. % or from 22 wt. % to 26 wt. % of tungsten or a sulfide or oxide of tungsten), from 2 wt. % to 8 wt. % of an oxide or sulfide of nickel (such as from 3 wt. % to 7 wt. % or from 4 wt. % to 6 wt. % of an oxide or sulfide of nickel), and from 5 wt. % to 40 wt. % of zeolite (such as from 10 wt. % to 35 wt. % or from 10 wt. % to 30 wt. % of zeolite). In another embodiment, the hydrocracking catalyst may comprise from 12 wt. % to 18 wt. % of an oxide or sulfide of molybdenum (such as from 13 wt. % to 17 wt. % or from 14 wt. % to 16 wt. % of an oxide or sulfide of molybdenum), from 2 wt. % to 8 wt. % of an oxide or sulfide of nickel (such as from 3 wt. % to 7 wt. % or from 4 wt. % to 6 wt. % of an oxide or sulfide of nickel), and from 5 wt. % to 40 wt. % of zeolite (such as from 10 wt. % to 35 wt. % or from 10 wt. % to 30 wt. % of zeolite).

The embodiments of the hydrotreating catalysts described may be fabricated by selecting a zeolite and impregnating the zeolite with one or more catalytic metals or by comulling zeolite with other components. For the impregnation method, the zeolite, active alumina (for example, boehmite alumina), and binder (for example, acid peptized alumina) may be mixed. An appropriate amount of water may be added to form a dough that can be extruded using an extruder. The extrudate may be dried at 80° C. to 120° C. for 4 hours to 10 hours, and then calcinated at 500° C. to 550° C. for 4 hours to 6 hours. The calcinated extrudate may be impregnated with an aqueous solution prepared by the compounds comprising Ni, W, Mo, Co, or combinations thereof. Two or more metal catalyst precursors may be utilized when two metal catalysts are desired. However, some embodiments may include only one of Ni, W, Mo, or Co. For example, the catalyst support material may be impregnated by a mixture of nickel nitrate hexahydrate (that is, $Ni(NO_3)_2 \cdot 6H_2O$) and ammonium metatungstate (that is, $(NH_4)_6H_2W_{12}O_{40}$) if a W—Ni catalyst is desired. The impregnated extrudate may be dried at 80° C. to 120° C. for 4 hours to 10 hours, and then calcinated at 450° C. to 500° C. for 4 hours to 6 hours. For the comulling method, the zeolite may be mixed with alumina, binder, and the compounds comprising W or Mo, Ni or Co (for example $MoO_3$ or nickel nitrate hexahydrate if Mo—Ni is desired).

It should be understood that some embodiments of the presently described methods and systems may utilize a hydrotreating catalyst that includes a mesoporous zeolite (that is, having an average pore size of from 2 nm to 50 nm). However, in other embodiments, the average pore size of the zeolite may be less than 2 nm (that is, microporous).

In one or more embodiments, one or more streams from the hydrotreatment unit 170 may be passed to one or more of the SECC unit 140 or the steam cracking unit 120. As is depicted in FIG. 1, in some embodiments, a portion of the hydrotreated heavy component stream from the hydrotreatment unit 170 may be passed to the SECC unit 140, and another portion of the hydrotreated heavy component stream from the hydrotreatment unit 170 may be passed to the steam cracking unit 120. In one or more embodiments, the hydrotreated heavy component stream may be separated into at least three streams including the hydrotreated light gas fraction stream 171, the hydrotreated light fraction stream 172, and the hydrotreated heavy fraction stream 173. The hydrotreated light gas fraction stream 171 may include $C_2$-$C_4$ alkanes and methane, which may be formed by the hydrotreatment unit 170. In some embodiments, the hydrotreated light gas stream may have a final boiling point of less than 35° C. such as less than 30° C. The hydrotreated light fraction stream 172 may be a hydrotreated light fraction. In some embodiments, the lightest components of the hydrotreated light fraction stream 172 may be those that are liquid at the environmental temperatures (such as the natural temperature at the plant site). The hydrotreated heavy fraction stream 173 may be a hydrotreated heavy fraction. The cut point between the hydrotreated light fraction stream 172 and the hydrotreated heavy fraction stream 173 may be from 280° C. to 320° C., such as from 290° C. to 310° C.

According to the embodiments presently disclosed, a number of advantages may be present over conventional conversion systems which do not separate the hydrocarbon feed stream into three or more streams prior to introduction into cracking. That is, conventional cracking units which inject, for example, the entirety of the feedstock hydrocarbon into a steam cracker unit may be deficient in certain respects as compared with the conversions system of FIG. 1. For example, by separating the hydrocarbon feed stream 102 prior to introduction into the steam cracking unit 120, a higher amount of light olefins may be produced. According to the embodiments presently described, by only introducing the light gas fraction stream 106 to the steam cracking unit 120, the amount of light gas products such as hydrogen, methane, ethylene, propylene, butadiene, and mixed butenes may be increased, while the amount of greater boiling point products such as hydrocarbon oil can be reduced. At the same time, the light fraction stream 107 and the heavy fraction stream 108 may be converted via the SECC unit 140 into fuel gas, $C_2$-$C_4$ alkanes, light olefins, gasoline, light cycle oil and/or heavy cycle oil. Components from the steam cracker and SECC effluent streams can be further separated into product streams and recycle streams. Product streams may include the fuel gas stream 181, the light olefin stream 182, and/or the BTX stream 183. Recycle streams may include the $C_2$-$C_4$ alkanes and methane stream 185, which can be sent back to the steam cracking unit 120. Another recycle stream may include the heavy component stream 184 comprising cracked naptha, light cycle oil, and heavy cycle oil, which can be sent to the hydrotreatment unit 170 to upgrade the quality of these heavier components. The hydrotreated effluent streams may be recycled to the cracking units. According to another embodiment, hydrotreating the heavy components in the heavy component stream 184 before recycling results in less catalyst deactivation and coke formation in the SECC unit 140 than would otherwise occur. According to another embodiment, coking in the steam cracking unit 120 may be reduced by the elimination of materials present in the light fraction stream 107 and the heavy fraction stream 108. Without being bound by theory, it is believed that injecting highly aromatic feeds into a steam cracker unit may result in greater boiling point products and increased coking. Thus, it is believed that coking can be reduced and greater quantities of lesser boiling point products can be produced by the steam cracking unit 120 when highly-aromatic materials are not introduced to the steam cracking unit 120 and are instead separated into at least a portion of the light fraction stream 107 and heavy the heavy fraction stream 108 by the feed separator 104.

According to another embodiment, capital costs may be reduced by the designs of the hydrocarbon feed conversion system 100 of FIG. 1. Since the hydrocarbon feed stream 102 is fractionated by the feed separator 104, not all of the cracking furnaces of the system need to be designed to handle the materials contained in the light fraction stream 107 and the heavy fraction stream 108. It is expected that system components designed to treat light gas materials such as those contained in the light gas fraction stream 106 would be less expensive than system components designed to treat greater boiling point materials, such as those contained in the light fraction stream 107 and the heavy fraction stream 108. For example, the convection zone of the steam cracking unit 120 can be designed simpler and cheaper than an equivalent convection zone that is designed to process the materials of the light fraction stream 107 and the heavy stream 108.

According to another embodiment, system components such as vapor-solid separation devices and vapor-liquid separation devices may not need to be utilized between the convection zone and the pyrolysis zone of the steam cracking unit 120. In some conventional steam cracker units, a vapor-liquid separation device may be required to be positioned between the convection zone and the pyrolysis zone. This vapor-liquid separation device may be used to remove the greater boiling point components present in a convection zone, such as any vacuum residues. However, in some embodiments of the hydrocarbon feed conversion system 100 of FIG. 2, a vapor-liquid separation device may not be needed, or may be less complex since it does not encounter greater boiling point materials such as those present in the light fraction stream 107 and the heavy fraction stream 108. Additionally, in some embodiments described, the steam cracking unit 120 may be able to be operated more frequently (that is, without intermittent shut-downs) caused by the processing of relatively heavy feeds. This higher frequency of operation may sometimes be referred to as increased on-stream-factor.

EXAMPLES

The various embodiments of methods and systems for the conversion of a feedstock fuels will be further clarified by the following examples. The examples are illustrative in nature, and should not be understood to limit the subject matter of the present disclosure. All simulations were modeled in Aspen HYSYS according to embodiments of the present disclosure.

Inventive Example A

Inventive Example A provides a simulation of an integrated system similar to FIG. 1 wherein the SECC unit 140 operated at a temperature of 675° C. with a steam to hydrocarbon ratio of 1:1. The simulation was run with AXL as the hydrocarbon feed stream 102. The molar flow, mass flow, and wt % of each stream is given in Table 1.

TABLE 1

Composition of streams according to Inventive Example A

| Line Number | 102 | 108 | 107 | 106 | 121 | 181 | 183 |
|---|---|---|---|---|---|---|---|
| Molar Flow [kgmole/h] | 3569 | 713 | 2587 | 269 | 3342 | 2719 | 27 |
| Mass Flow [kg/h] | 653712 | 293322 | 344421 | 15969 | 68272 | 5481 | 2267 |
| wt % of Feed | 100.0 | 44.9 | 52.7 | 2.4 | 10.4 | 0.8 | 0.3 |

TABLE 1-continued

Composition of streams according to Inventive Example A

| Feed | | | | | | | |
|---|---|---|---|---|---|---|---|
| Line Number | 184 | 172 | 171 | 185 | 173 | 141 | 182 |
| Molar Flow [kgmole/h] | 294 | 273 | 120 | 1354 | 26 | 18954 | 11157 |
| Mass Flow [kg/h] | 70975 | 43162 | 2542 | 52287 | 6646 | 692664 | 416800 |
| wt % of Feed | 10.9 | 6.6 | 0.4 | 8.0 | 1.0 | 106.0 | 63.8 |

Comparative Example 1

Comparative Example 1 provides a modified simulation of Inventive Example 1, wherein a conventional fluidized catalytic cracking unit (FCC) is substituted for the SECC in the system. The FCC unit operated at a temperature of 675° C. with a steam to hydrocarbon ratio of 1:20. The molar flow, mass flow, and wt % of each stream is given in Table 2.

TABLE 2

Composition of streams according to Comparative Example 1

| Line Number | 102 | 108 | 107 | 106 | 121 | 181 | 183 |
|---|---|---|---|---|---|---|---|
| Molar Flow [kgmole/h] | 3569 | 499 | 2801 | 269 | 3325 | 1382 | 33 |
| Mass Flow [kg/h] | 653712 | 234085 | 403658 | 15969 | 72241 | 2785 | 2790 |
| wt % of Feed | 100.0 | 35.8 | 61.7 | 2.4 | 11.1 | 0.4 | 0.4 |
| Line Number | 184 | 172 | 171 | 185 | 173 | 141 | 182 |
| Molar Flow [kgmole/h] | 493 | 431 | 200 | 1308 | 51 | 12505 | 6260 |
| Mass Flow [kg/h] | 122275 | 68078 | 4291 | 56256 | 13061 | 716189 | 251107 |
| wt % of Feed | 18.7 | 10.4 | 0.7 | 8.6 | 2.0 | 109.6 | 38.4 |

A comparison of Tables 1 and 2 reveals that the integrated system employing the SECC is more efficient, resulting in a lower yield of the heavy component stream 184 (10.9 wt. % vs. 18.7 wt. %), which is fed into the hydrotreatment unit 170 before being recycled to the cracking units. Additionally, the integrated system employing the SECC provides a higher yield of the fuel gas stream 181 (0.8 wt. % vs. 0.4 wt. %). Most notably, a much higher yield of the light olefin stream 182 was obtained when employing the SECC (63.8 wt. %) vs. the FCC (38.4 wt. %). These results are consistent with the conditions employed by the SECC providing higher conversions of $C_{5+}$ hydrocarbons and greater selectivity for light olefin products.

For the purposes of defining the present technology, the transitional phrase "consisting of" may be introduced in the claims as a closed preamble term limiting the scope of the claims to the recited components or steps and any naturally occurring impurities.

For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter.

The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B and C should be interpreted as also disclosing a composition "consisting of" components A, B, and C as well as a composition "consisting essentially of" components A, B, and C.

Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

It should be understood that any two quantitative values assigned to a property may constitute a range of that property, and all combinations of ranges formed from all stated quantitative values of a given property are contemplated in this disclosure. It should be appreciated that compositional ranges of a chemical constituent in a stream or in a reactor should be appreciated as containing, in some embodiments, a mixture of isomers of that constituent. For example, a compositional range specifying butene may include a mixture of various isomers of butene. It should be appreciated that the examples supply compositional ranges for various streams, and that the total amount of isomers of a particular chemical composition can constitute a range.

In a first aspect of the present disclosure, light olefins may be produced from a hydrocarbon feed by a method that may comprise introducing the hydrocarbon feed having an American Petroleum Institute (API) gravity value above 35° into a feed separator to separate the hydrocarbon feed into at least a light gas fraction stream comprising $C_1$-$C_4$ alkanes, a light fraction stream comprising $C_{5+}$ alkanes, and a heavy fraction stream, wherein the temperature cut between the light fraction stream and the heavy fraction stream is from 280° C. to 320° C. The method may also comprise passing the light gas fraction stream to a steam cracker to steam crack at least a portion of the light gas fraction stream and produce a steam cracked effluent stream; and introducing the light fraction stream and the heavy fraction stream to a steam enhanced catalytic cracker (SECC) in the presence of steam to catalytically crack at least a portion of the light fraction stream and the heavy fraction stream and produce a catalytically cracked effluent stream. The weight ratio of steam to the light fraction stream and the heavy fraction stream may be from 1:5 to 1:1. The method may further comprise passing the steam cracked effluent stream and the catalytically cracked effluent stream to a product separator to produce the light olefins.

A second aspect of the present disclosure may include the first aspect where the product separator may also yield a heavy component stream, said heavy component stream may comprise cracked naphtha, light cycle oil with components having boiling points from 221° C. to 343° C., and heavy cycle oil with components having boiling points greater than 343° C. The method may further comprise passing the heavy component stream to a hydrotreater to produce a hydrotreated heavy component stream; and recycling at least a portion of the hydrotreated heavy component stream to the SECC to catalytically crack at least a portion of the hydrotreated heavy component stream. The weight ratio of steam to hydrocarbon may be from 1:5 to 1:1.

A third aspect of the present disclosure may include the second aspect where the heavy component stream may be separated in the hydrotreater into a hydrotreated light gas fraction stream comprising $C_1$-$C_4$ alkanes, a hydrotreated light fraction stream comprising $C_{5+}$ alkanes, and a hydrotreated heavy fraction stream, wherein the temperature cut between the hydrotreated light fraction stream and the hydrotreated heavy fraction stream may be at 280° C. to 320° C.

A fourth aspect of the present disclosure may include any of the first through third aspects where the light olefins may comprise ethylene, propylene, butadiene, and mixed butenes.

A fifth aspect of the present disclosure may include any of the first through fourth aspects where the steam cracker may operate at a temperature from 800° C. to 950° C.

A sixth aspect of the present disclosure may include any of the first through fifth aspects where the feed separator may operate at a temperature of 200° C. to 400° C., and the SECC may operate at a temperature of 550° C. to 800° C.

A seventh aspect of the present disclosure may include the sixth aspect where the SECC unit operates at a temperature of 600° C. to 750° C.

An eighth aspect of the present disclosure may include any of the first through seventh aspects where the SECC may comprise one or more catalysts selected from ZSM-5 and USY.

A ninth aspect of the present disclosure may include any of the first through eighth aspects where the light gas fraction may have a final boiling point of less than 35° C.

A tenth aspect of the present disclosure may include any of the first through ninth aspects where the light fraction may have a final boiling point of less than 300° C.

An eleventh aspect of the present disclosure may include any of the first through tenth aspects where at least 90 wt. % of the hydrocarbon material may be present in the combination of the light gas fraction, the light fraction, and the heavy fraction.

In a twelfth aspect of the present disclosure, light olefins may be produced from a hydrocarbon feed by a method that may comprise separating the hydrocarbon feed having an American Petroleum Institute (API) gravity value above 35° into at least a light gas fraction stream comprising $C_1$-$C_4$ alkanes, a light fraction stream comprising $C_{5+}$ alkanes, and a heavy fraction stream. The temperature cut between the light fraction stream and the heavy fraction stream may be at 280° C. to 320° C. The method may further comprise non-catalytically steam cracking the light gas fraction stream to produce a steam cracked effluent stream; and catalytically cracking the light fraction stream and the heavy fraction stream in the presence of steam to produce a catalytically cracked effluent stream. The weight ratio of steam to the light fraction stream and the heavy fraction stream may be from 1:5 to 1:1. The method may further comprise separating the steam cracked effluent stream and the catalytically cracked effluent stream to produce the light olefins.

A thirteenth aspect of the present disclosure may include the twelfth aspect where the separating of the steam cracked effluent stream and the catalytically cracked effluent stream also may yield a heavy component stream, said heavy component stream comprising cracked naphtha, light cycle oil with components having boiling points from 221° C. to 343° C., and heavy cycle oil with components having boiling points greater than 343° C.

A fourteenth aspect of the present disclosure may include the thirteenth aspect where the method may further comprise hydrotreating the heavy component stream to produce a hydrotreated heavy component stream; and recycling at least a portion of the hydrotreated heavy component stream to be catalytically cracked.

A fifteenth aspect of the present disclosure may include any of the twelfth through fourteenth aspects where the light olefins may comprise ethylene, propylene, butadiene, and mixed butenes.

A sixteenth aspect of the present disclosure may include any of the twelfth through fifteenth aspects where the non-catalytic cracking may occur at a temperature from 800° C. to 950° C.

A seventeenth aspect of the present disclosure may include any of the twelfth through sixteenth aspects where the catalytic cracking may operate at a temperature of 600° C. to 750° C.

An eighteenth aspect of the present disclosure may include any of the twelfth through seventeenth aspects where the catalytic cracking may occur in the presence of one or more catalysts selected from ZSM-5 and USY.

A nineteenth aspect of the present disclosure may include any of the twelfth through eighteenth aspects where the light gas fraction may have a final boiling point of less than 35° C.

A twentieth aspect of the present disclosure may include any of the twelfth through nineteenth aspects where the light fraction may have a final boiling point of less than 300° C.

The subject matter of the present disclosure has been described in detail and by reference to specific embodiments. It should be understood that any detailed description of a component or feature of an embodiment does not necessarily imply that the component or feature is essential to the particular embodiment or to any other embodiment. Further, it should be apparent to those skilled in the art that various modifications and variations can be made to the described embodiments without departing from the spirit and scope of the claimed subject matter.

What is claimed is:

1. A method for producing light olefins from a hydrocarbon feed, the method comprising:

introducing the hydrocarbon feed having an American Petroleum Institute (API) gravity value above 35° into a feed separator to separate the hydrocarbon feed into at least a light gas fraction stream comprising $C_1$-$C_4$ alkanes, a light fraction stream comprising $C_{5+}$ alkanes, and a heavy fraction stream, wherein the temperature cut between the light fraction stream and the heavy fraction stream is from 280° C. to 320° C.;

passing the light gas fraction stream to a steam cracker to steam crack at least a portion of the light gas fraction stream and produce a steam cracked effluent stream;

preheating the heavy fraction stream to a temperature of less than or equal to 250° C. by mixing the heavy fraction with steam prior to introduction to a steam enhanced catalytic cracker;

introducing the light fraction stream and the heavy fraction stream to the steam enhanced catalytic cracker (SECC) in the presence of steam and one or more catalysts selected from ZSM-5 and USY to catalytically crack at least a portion of the light fraction stream and the heavy fraction stream and produce a catalytically cracked effluent stream, wherein the weight ratio of steam to the light fraction stream and the heavy fraction stream is from 1:5 to 1:1; and passing the steam cracked effluent stream and the catalytically cracked effluent stream to a product separator to produce the light olefins;

wherein the light fraction stream has a final boiling point of less than 300° C.

2. The method of claim 1 wherein the product separator also yields a heavy component stream, said heavy component stream comprising cracked naphtha, light cycle oil with components having boiling points from 221° C. to 343° C., and heavy cycle oil with components having boiling points greater than 343° C.;

passing the heavy component stream to a hydrotreater to produce a hydrotreated heavy component stream; and recycling at least a portion of the hydrotreated heavy component stream to the SECC to catalytically crack at least a portion of the hydrotreated heavy component stream, wherein the weight ratio of steam to hydrocarbon is from 1:5 to 1:1.

3. The method of claim 2, wherein the heavy component stream is separated in the hydrotreater into a hydrotreated light gas fraction stream comprising $C_1$-$C_4$ alkanes, a hydrotreated light fraction stream comprising $C_{5+}$ alkanes, and a hydrotreated heavy fraction stream, wherein the temperature cut between the hydrotreated light fraction stream and the hydrotreated heavy fraction stream is at 280° C. to 320° C.

4. The method of claim 1, wherein the light olefins comprise ethylene, propylene, butadiene, and mixed butenes.

5. The method of claim 1, wherein the steam cracker operates at a temperature from 800° C. to 950° C.

6. The method of claim 1, wherein the feed separator operates at a temperature of 200° C. to 400° C., and the SECC operates at a temperature of 550° C. to 800° C.

7. The method of claim 6, wherein the SECC unit operates at a temperature of 600° C. to 750° C.

8. The method of claim 1, wherein the light gas fraction has a final boiling point of less than 35° C.

9. The method of claim 1, wherein at least 90 wt. % of the hydrocarbon material is present in the combination of the light gas fraction, the light fraction, and the heavy fraction.

10. A method for producing light olefins from a hydrocarbon feed, the method comprising:

separating the hydrocarbon feed having an American Petroleum Institute (API) gravity value above 35° into at least a light gas fraction stream comprising $C_1$-$C_4$ alkanes, a light fraction stream comprising $C_{5+}$ alkanes, and a heavy fraction stream, wherein the temperature cut between the light fraction stream and the heavy fraction stream is at 280° C. to 320° C.; and non-catalytically steam cracking the light gas fraction stream to produce a steam cracked effluent stream;

preheating the heavy fraction stream to a temperature of less than or equal to 250° C. by mixing the heavy fraction with steam prior to catalytically cracking the heavy fraction stream;

catalytically cracking the light fraction stream and the heavy fraction stream in the presence of steam and one or more catalysts selected from ZSM-5 and USY to produce a catalytically cracked effluent stream, wherein the weight ratio of steam to the light fraction stream and the heavy fraction stream is from 1:5 to 1:1; and separating the steam cracked effluent stream and the catalytically cracked effluent stream to produce the light olefins;

wherein the light fraction stream has a final boiling point of less than 300° C.

11. The method of claim 10, wherein the separating of the steam cracked effluent stream and the catalytically cracked effluent stream also yields a heavy component stream, said heavy component stream comprising cracked naphtha, light cycle oil with components having boiling points from 221° C. to 343° C., and heavy cycle oil with components having boiling points greater than 343° C.

12. The method of claim 11, further comprising:

hydrotreating the heavy component stream to produce a hydrotreated heavy component stream; and recycling at least a portion of the hydrotreated heavy component stream to be catalytically cracked.

13. The method of claim 10, wherein the light olefins comprise ethylene, propylene, butadiene, and mixed butenes.

14. The method of claim 10, wherein the non-catalytic cracking occurs at a temperature from 800° C. to 950° C.

15. The method of claim 10, wherein the catalytic cracking operates at a temperature of 600° C. to 750° C.

16. The method of claim 10, wherein the light gas fraction has a final boiling point of less than 35° C.

17. The method of claim 1, wherein the one or more catalysts comprises a mixture of Y and ZSM-5 embedded with clay, alumina, and binder.

18. The method of claim 1, wherein the light fraction stream and the heavy fraction stream are passed directly from the feed separator to the SECC.

19. The method of claim 1, wherein preheating the heavy fraction stream to a temperature of less than or equal to 250° C. by mixing the heavy fraction with steam vaporizes at least a portion of the heavy fraction stream without cracking the same.

20. The method of claim 10, wherein preheating the heavy fraction stream to a temperature of less than or equal to 250° C. by mixing the heavy fraction with steam vaporizes at least a portion of the heavy fraction stream without cracking the same.

* * * * *